United States Patent [19]

Miura et al.

[11] 4,147,033

[45] Apr. 3, 1979

[54] SECONDARY AIR SUPPLY SYSTEM FOR INTERNAL COMBUSTION ENGINES

[75] Inventors: Motohisa Miura, Kariya; Mikiji Ito, Nagoya, both of Japan

[73] Assignee: Nippondenso Co., Ltd., Kariya, Japan

[21] Appl. No.: 858,625

[22] Filed: Dec. 6, 1977

[30] Foreign Application Priority Data

Dec. 8, 1976 [JP] Japan ..... 51-147380

[51] Int. Cl.[2] ..... F01N 3/10

[52] U.S. Cl. ..... 60/290

[58] Field of Search ..... 60/289, 290

[56] References Cited

U.S. PATENT DOCUMENTS

| | | | |
|---|---|---|---|
| 3,591,961 | 7/1971 | Woodward | 60/290 |
| 3,748,855 | 7/1973 | Day | 60/290 |
| 3,791,146 | 2/1974 | Hayashi | 60/289 |
| 3,805,522 | 4/1974 | Sheppard | 60/290 |
| 3,945,205 | 3/1976 | Atago | 60/290 |
| 3,975,905 | 8/1976 | Shimo | 60/290 |

*Primary Examiner*—Douglas Hart

*Attorney, Agent, or Firm*—Cushman, Darby & Cushman

[57] ABSTRACT

A relief pressure control valve for controlling the pressure in a secondary air supply line has first and second pressure chambers divided by a diaphragm, a spring for biasing the diaphragm towards the second pressure chamber, a relief port connected to the secondary air supply line, a valve head connected to the diaphragm and being biased to close the relief port.

The air pumped out from an air pump is supplied to the first pressure chamber and the first pressure chamber is communicated with the second pressure chamber through an orifice. Accordingly, during stable running operations of the engine, the pressures in the first and second pressure chambers are made equal by means of the orifice, while during the accelerations pressure difference is produced between the chambers for a certain time period. The pressure difference urges the diaphragm in the same direction as that of the urging force of the spring, whereby the pressure in the secondary air supply line controlled by the relief pressure control valve is increased during the accelerations so as to supply the increased amount of the secondary air to the exhaust pipe of the engine.

4 Claims, 1 Drawing Figure

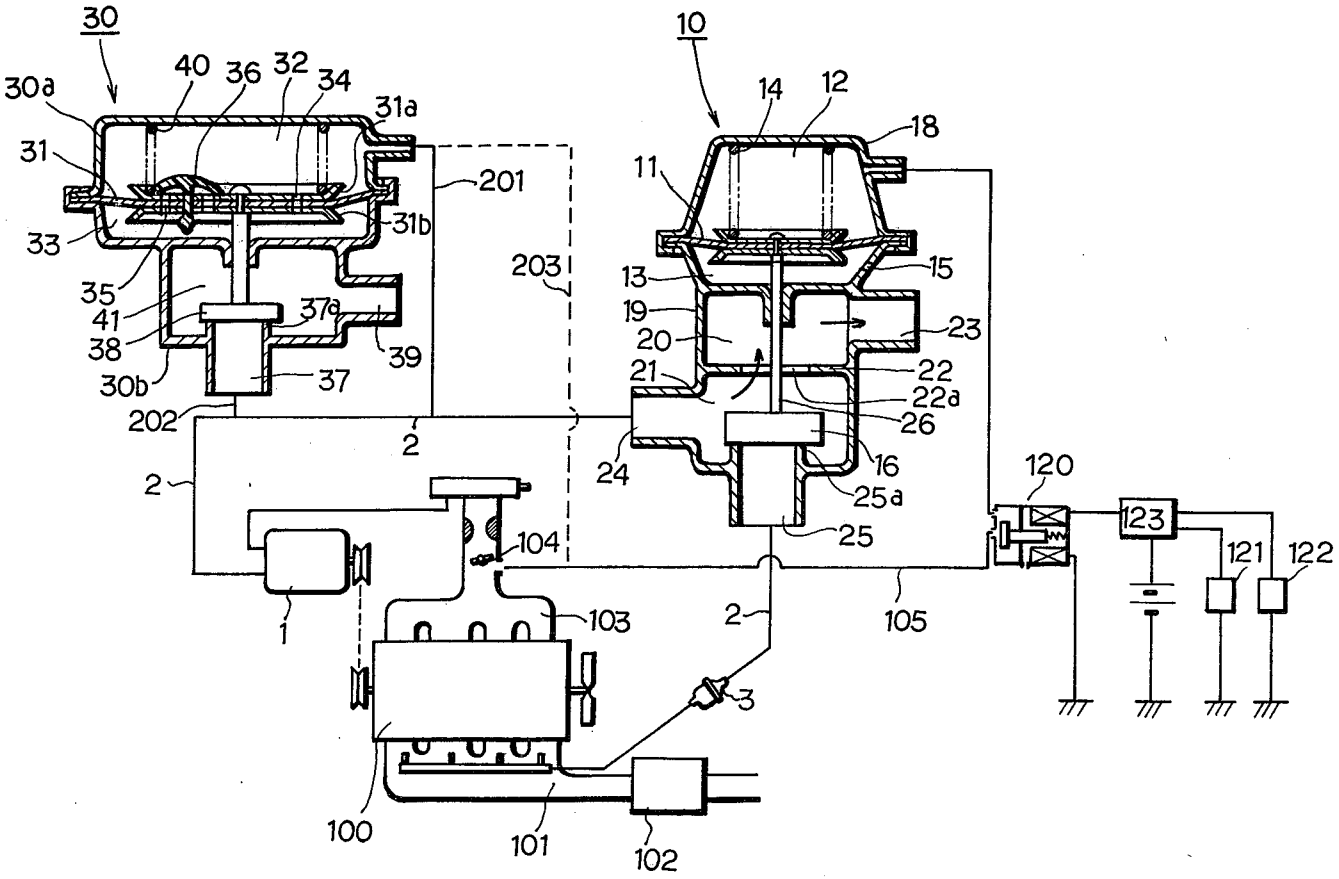
10
11
12
13
14
15
16
18
19
20
21
22
22a
23
24
25
25a
26
2
3
100
101
102
103
104
105
120
121
122
123
1
30
30a
30b
31
31a
31b
32
33
34
35
36
37
37a
38
39
40
41
201
202
203

SECONDARY AIR SUPPLY SYSTEM FOR INTERNAL COMBUSTION ENGINES

BACKGROUND OF THE INVENTION

1. Field of the Invention

The present invention relates to a secondary air supply system for an internal combustion engine for supplying a secondary air to an exhaust pipe of the engine for the purpose of reducing emission of harmful components of exhaust gases.

2. Description of the Prior Art

In a conventional secondary air supply system, a relief-pressure control valve is provided in a secondary air supply line connecting an air pump with the exhaust pipe of the engine so as to maintain the pressure in the secondary air supply line below a predetermined value. An air switching valve is also provided in the secondary air supply line for cutting off the supply of the secondary air in accordance with operational conditions of the engine. In the conventional relief-pressure control valve, the relief pressure is designed at a relatively low value for elongating the lifetime of the air pump.

Generally speaking, the emissions of unburned hydrocarbon (HC) and carbon monoxide (CO) are extremely increased during a rapid acceleration of the engine. It is, therefore necessary to supply an increased amount of the secondary air to the exhaust pipe during the accelerations.

In the conventional secondary air supply system described above, however, since the air from the air pump is bypassed to the atmosphere when the pressure of the air in the secondary air supply line exceeds the predetermined relief-pressure, the sufficient amount of the secondary air may not supplied to the exhaust pipe even though the air pump can supply the increased amount of air therefrom.

According to the prior art of this kind, which is disclosed in a Japanese laid-open utility model application 50-52307, the secondary air control valve has a pressure chamber to which the intake vacuum is applied during a normal running of the engine, a deformable diaphragm and a valve head connected to the diaphragm for controlling the amount of the secondary air in accordance with the intake vacuum applied to the pressure chamber.

An acceleration detecting device is further provided for increasing the amount of the secondary air during the accelerations. The device supplies the air from the air pump to the pressure chamber of the secondary air supply valve during the acceleration so that almost all of the air from the air pump may be supplied to the exhaust pipe of the engine.

As above, the prior art can supply the increased amount of the secondary air to the exhaust pipe during the accelerations, however it is disadvantageous that the amount of the secondary air can not be controlled in accordance with the degrees of the accelerations, and that the excess amount of the secondary air may be supplied to the exhaust pipe which would cause the over-heat of a catalyst or the like disposed in the exhaust pipe.

SUMMARY OF THE INVENTION

It is, therefore an object of the invention to provide a secondary air supply system for internal combustion engines which is capable of not only supplying the increased amount of the secondary air to the exhaust pipe during the accelerations but controlling the amount of the secondary air in accordance with the degrees of the accelerations.

In one aspect of the invention, a relief pressure control valve includes: upper and lower casings; a diaphragm interposed between the casings to define first and second chamber; the lower casing having a relief port connected at one end to a secondary air supply line connecting an air pump to an exhaust pipe; a valve head connected to and driven by said diaphragm to open and close said relief port in association with the other end of said relief port which is communicated to the atmosphere; a spring disposed in the first chamber for biasing the diaphragm and then the valve head to close the relief port; an orifice formed on the diaphragm for making the pressure in the second chamber equal to that in the first chamber, wherein the first chamber is supplied with the air from the air pump so that a pressure difference is produced during the accelerations in the engine. The pressure difference works on the diaphragm to bias the valve head to close the relief port with the result that the amount of the secondary air supplied to the exhaust pipe is increased and its increase responds to the degrees of the accelerations.

These and other objects and advantages of the invention may be readily ascertained by referring to the following description and appended drawing in which the drawing shows a schematic view partly in section of a secondary air supply system of the invention.

DETAILED DESCRIPTION OF THE PREFERRED EMBODIMENT

Referring to the drawing, numeral 1 designates a well-known air pump driven by an engine 100 for pumping out and supplying the pressurized air to an exhaust pipe 101 through a secondary air supply line 2, an air-switching-valve 10 is disposed in the line 2 and a check valve 3 is also disposed in the line for preventing the back flow of the exhaust gases. An exhaust gas purifying device 102 such as a three-way catalyst, an afterburner or the like, is disposed in the exhaust pipe 101 downstream of a portion where the secondary air is supplied.

The air-switching-valve 10 cuts-off the supply of the secondary air during the certain operational conditions of the engine, the operation of which will be described later. The valve 10 comprises upper and lower housings 18 and 19, a diaphragm 11 interposed between the two housings for defining therein first and second chambers 12 and 13, a spring 14 disposed in the first chamber 12 for urging the diaphragm 11 towards the second chamber 13, and an opening 15 formed on the lower housing 19 for communicating the second chamber 13 with the atmosphere. The lower housing 19 includes therein first and second compartments 20 and 21 divided by a wall 22, a first outlet port 23 communicating the first compartment 20 with the atmosphere, an inlet port 24 connected to the air pump 1 through the line 2, and a second outlet port 25 connected to the check valve 3 through the line 2, both of the inlet and outlet ports 24 and 25 opening to the second compartment 21.

The first and second compartments 20 and 21 are communicated with each other through an aperture **22*a* provided in the wall 22. A valve head 16 is disposed in the second compartment 21 and is connected to the diaphragm 11 via a rod 26. When the atmospheric pressure is applied to the first chamber 12, the valve head 16 is moved downwardly by means of the urging force of the spring 14 and seated on the upper end 25***a* of the second outlet port 25 to close the same, wherein the upper end 25*a* acts as a lower valve seat. On the other hand, when the intake vacuum is applied to the first chamber 12, the diaphragm 11 is lifted against the urging force of the spring 14 and the upper surface of the valve head 16 seats on the undersurface of the wall 22. Since the undersurface of the wall 22 acts as an upper valve seat, the aperture 22*a* is closed with the result that the intercommunication between the compartments 20 and 21 is shut off.

Numeral 30 designates a relief pressure control valve for maintaining the pressure of the air in the line 2 below a predetermined value. The valve 30 comprises upper and lower casings 30*a* and 30*b*, a diaphragm 31 interposed between the upper and lower casings 30*a* and 30*b* for defining first and second pressure chambers 32 and 33, retainers 31*a* and 31*b* fixed to the diaphragm 31 from the both sides, and a compression spring 40 disposed in the first pressure chamber 32 for urging the retainers 31*a*, 31*b* and the diaphragm 31 towards the second pressure chamber 33, wherein the first pressure chamber 32 is communicated with the secondary air supply line 2 through a pressure line 201.

A small orifice 34 is formed on the diaphragm 31 and retainers 31*a* and 31*b* for intercommunicating the first and second pressure chambers 32 and 33 with each other, so that under the stable operation of the engine the pressure in the second pressure chamber 33 is equal to that in the first pressure chamber 32.

Apertures 35 having large diameters are also formed on the diaphgram 31 and retainers 31*a* and 31*b* for commuicating the first chamber 32 with the second chamber 33.

A check valve 36 is provided to prevent the counterflow through the apertures 35 from the first to the second chambers, so that the apertures are opened only when the pressure in the second chamber 33 is higher than that in the first chamber 32.

The lower casing 30*b* of the relief pressure control valve 30 has a compartment 41, a relief port 37 connected to the line 2 via a pressure line 202, and an outlet port 39 opening to the atmosphere, wherein both of the ports 37 and 39 are communicated with the compartment 41.

A valve head 38 is disposed in the compartment 41 and is connected to the diaphragm 31 for opening and closing the relief port 37.

During a normal running of the engine, the pressure in the second chamber 33 is made equal to that in the first chamber 32 through the orifice 34, and so the diphragm 31 is moved downwardly by the urging force of the spring 40, whereby the valve head 38 is moved downwardly towards the upper portion 37*a* of the relief port 37. When the valve head 38 seats on the upper portion 37*a* of the relief port, the relief port 37 is closed so that no air from the air pump 1 flows out of the outlet port 39.

The pressure of the air in the secondary air supply line 2, especially in the pressure relief port 37 works on the undersurface of the valve head 38 to urge the same in a direction opposite to the urging force of the spring 40. When the force working on the valve head 38 becomes higher than the urging force of the spring 40, the valve head 38 is lifted to open the relief port 37, to thereby permit a portion of the air from the air pump 1 to flow into the atmosphere through the opened relief port 37, the compartment 41 and the outlet port 39. As above, the valve 30 maintains the pressure of the air in the line 2 below the predetermined value, which is defined by the urging force of the compression spring 40 in a case of the stable operation of the engine.

Numeral 120 designates an electromagnetic three-way valve of a known type, which controls the application of either the atmospheric pressure or the intake vacuum to the first chamber 12 of the air switching valve 10 in accordance with the operational conditions of the engine. For the purpose, the valve 120 is disposed in a pressure line 105 connecting the intake pipe 103 with the first chamber 12 and it is actuated and controlled by a control circuit 123. Numeral 121 designates a temperator sensor for detecting the temperature of cooling water of the engine, and numeral 122 designates a speed sensor for detecting the running speed of the vehicle.

The outputs of the sensors 121 and 122 are supplied to the control circuit 123, so that the control circuit 123 actuates the electromagnetic valve 120 both when the temperature of the engine is within a fixed range and when the vehicle running speed is lower than a preset level. When the valve 120 is actuated, the first chamber 12 of the valve 10 is communicated with the intake pipe 103 downstream of a throttle valve 104 through the pressure line 105, thus opening the outlet port 25 to allow the air from the air pump 1 to be injected into the exhaust pipe 101.

An operation of the system just described will be explained hereinafter.

When the temperature of the engine detected by the temperature sensor 121 is within the fixed range, for example, from 30° to 90° C. and when the vehicle running speed is lower than the preset level of 80 to 100 Km/hours, the electromagnetic valve 120 is energized to communicate the first chamber 12 with the intake pipe 103. When the intake vacuum is applied to the chamber 12, the valve head 16 is lifted to open the outlet port 25, thus to supply the secondary air from the air pump 1 to the exhaust pipe 101 through the check valve 3.

Under the condition, when the engine 100 is running at a constant speed, the air pump 1 is also driven at a constant speed, whereby the pressure of air pumped out from the pump 1 is almost constant too. Accordingly, the pressure in the second pressure chamber 33 is made equal to that in the first pressure chamber 32 by means of the orifice 34. The valve head 38 is thereby biased towards the relief port 37 only by the urging force of the spring 40. So, when the force acting on the valve head 38 in the direction opposite to that of the spring 40 exceeds the relief pressure, in this case which is equal to the urging force of the spring 40, the valve head 38 is lifted to open the relief port 37.

During the decelerations of the vehicle, as the engine speed decreases the pressure of air pumped out from the air pump 1 is decreased. The pressure in the first chamber 32 is decreased and becomes temporarily lower than that in the second chamber 33. However, since the check valve 36 opens the operatures 35 because of the pressure difference, the pressures in the chambers 32 and 33 become the same value in a moment. Accordingly, the relief pressure of the valve 30 is not changed during the decelerations.

During the accelerations of the vehicle, the pressure of the pumped air from the air pump 1 increases as the engine speed increases, and thereby the pressure in the first chamber 32 becomes higher than that in the second chamber 33. The pressure difference between the chambers 32 and 33 caused by the increase of the pressure of the pumped air urges the diaphragm 31 towards the second chambers 33, that is in the same direction as that of the urging force of the spring 40. As above, the relief pressure of the valve 30 is defined by the sum of the urging force of the spring 40 and the pressure difference between the chambers 32 and 33 during the accelerations. Since the relief pressure of the valve 30 is increased, the pressure in the secondary air supply line 2 controlled by the valve 30 is also increased with the result that the amount of the secondary air supplied to the exhaust pipe is increased when compared with that during the stable running operations or the decelerations of the vehicle.

In the above accelerations, the steeper the acceleration is, the larger the pressure difference between the chambers 32 and 33 is, so that the relief pressure of the valve 30 increases as the degree of the accelerations becomes higher.

As time passes after the acceleration, the pressure difference between the chambers 32 and 33 gradually decreases because of the orifice 34. So, when a certain time has passed after the acceleration, the pressure difference between the chambers 32 and 33 becomes zero, so that the relief pressure of the valve 30 is defined by the urging force of the spring 40 alone. The certain time during which the pressure difference becomes zero is defined by the diameter of the orifice 34 and the volume of the second chamber 33. In the embodiment just described, the first pressure chamber 32 of the relief pressure control valve 30 is supplied with the pumped air from the air pump 1, however the intake vacuum may be applied thereto instead of the pumped air through a pressure line 203 as indicated by a dotted line in the drawing to perform the same function as described above.

The orifice 34 and the apertures 35 may not always be formed on the diaphragm 31, and instead they may be formed in a passage outside of the casings 30*a* and 30*b* communicating the first chamber 32 with the second chamber 33.

What is claimed is:

1. A secondary air supply system for an internal combustion engine comprising:

an air pump driven by an engine for pumping out the pressurized air;

a secondary air supply line connecting said air pump with an exhaust pipe of said engine for supplying the air from said air pump to said exhaust pipe as a secondary air; and a relief pressure control valve connected to said secondary air supply line for controlling the pressure of the air in said secondary air supply line, wherein said relief pressure control valve comprises:

upper and lower casings;

a diaphragm interposed between said upper and lower casings for defining therein first and second pressure chambers, said first pressure chamber being supplied with the air from said air pump;

a spring for biasing said diaphgram towards said second pressure chamber;

an orifice communicating said first pressure chamber with said second pressure chamber for making the pressure in said second pressure chamber equal to that in said first pressure chamber;

a relief port connected at one end to said secondary air supply line and communicated at the other end to the atmosphere;

a valve head connected to and driven by said diaphragm for opening and closing said relief port in cooperation with said other end thereof, said valve head being normally biased by said spring to close said relief port, whereby said relief port is opened in a stable running operation of said engine when the pressure of the air from said air pump exceeds a biasing force of said spring, a rapid pressure increase of the air from said air pump caused by the acceleration of said engine producing a pressure difference in said first and second pressure chambers, said pressure difference working on said diaphragm to bias said valve head to close said relief port, whereby said relief port is opened during the acceleration of said engine when the pressure of the air from said air pump exceeds another biasing force of a sum of said biasing force of said spring and said pressure difference.

2. A relief pressure control valve according to claim 1, further comprises:

an aperture formed on said diaphragm communicating said first and second pressure chambers with each other; and a check valve provided on said diaphragm for preventing fluid flow through said aperture from said first pressure chamber to said second pressure chamber.

3. A secondary air supply system for an internal combustion engine comprising:

an air pump driven by an engine for pumping out the air under a pressure;

a secondary air supply line connecting said air pump with an exhaust pipe of said engine for supplying the air from said air pump to said exhaust pipe as a secondary air;

an air switching valve disposed in said secondary air supply line for cutting off the supply of the secondary air during the predetermined operational conditions of said engine; and a relief pressure control valve connected to said air pump for controlling the pressure of the air in said secondary air supply line in accordance with the operational conditions of said engine, said relief pressure control valve comprising:

upper and lower casings;

a diaphragm interposed between said upper and lower casings for defining therein first second pressure chambers;

a relief port connected at one end to said secondary air supply line and communicated with the atmosphere at the other end;

a valve head associated with said other end of said relief port for opening and closing said relief port, said valve head being connected to and movable with said diaphragm;

a spring for biasing said valve head to close said relief port;

an orifice communicating said first and second pressure chambers with each other for making the pressure in said second pressure chamber equal to that is said first pressure chamber, whereby when the pressure in said second pressure chamber is made equal to that in said first pressure chamber and when the pressure in said secondary air supply line exceeds the biasing force of said spring said relief port is opened to maintain the pressure in said secondary air supply line within a predetermined level; and a pressure line connecting said secondary air supply line with said first pressure chamber for supplying the air from said air pump thereto, whereby the pressure in said first pressure chamber is made higher than that in said second pressure chamber during the accelerations of said engine to produce a pressure difference across said diaphragm, said pressure difference working on said diaphragm to bias said valve head to close said relief port, thus to maintain the pressure in said secondary air supply line within another predetermined level higher than said predetermined level.

4. A secondary air supply system according to claim 3 further comprising a check valve disposed in said secondary air supply line for preventing the back flow of the exhaust gases.

* * * * *